US011047200B2

(12) United States Patent
Emmons et al.

(10) Patent No.: US 11,047,200 B2
(45) Date of Patent: Jun. 29, 2021

(54) STRIPPER ELEMENT FOR WELLS AND REINFORCING INSERT THEREFOR

(71) Applicant: Elastomer Specialties, Inc., Wagoner, OK (US)

(72) Inventors: Orlin W. Emmons, Wagoner, OK (US); Darin W. Emmons, Wagoner, OK (US)

(73) Assignee: Elastomer Specialties, Inc., Wagoner, OK (US)

( * ) Notice: Subject to any disclaimer, the term of this patent is extended or adjusted under 35 U.S.C. 154(b) by 0 days.

(21) Appl. No.: 16/685,084

(22) Filed: Nov. 15, 2019

(65) Prior Publication Data

US 2021/0148183 A1 May 20, 2021

(51) Int. Cl.
*E21B 33/08* (2006.01)

(52) U.S. Cl.
CPC ..... *E21B 33/08* (2013.01)

(58) Field of Classification Search
CPC ..... E21B 33/08; E21B 2200/01
See application file for complete search history.

(56) References Cited

U.S. PATENT DOCUMENTS

| | | | | |
|---|---|---|---|---|
| 2,272,395 A | | 2/1942 | Ballagh | |
| 3,822,753 A | * | 7/1974 | Tate | E21B 33/08 175/84 |
| 4,125,266 A | | 11/1978 | Schonherr et al. | |
| 4,658,894 A | | 4/1987 | Craig | |
| 4,949,796 A | | 8/1990 | Williams | |
| 5,901,964 A | * | 5/1999 | Williams | E21B 33/085 277/326 |
| 6,268,056 B1 | | 7/2001 | Mills | |
| 7,708,089 B2 | | 5/2010 | Williams | |
| 8,197,737 B2 | | 6/2012 | Williams | |
| 8,596,345 B2 | | 12/2013 | Li et al. | |
| 8,870,186 B2 | | 10/2014 | Hoang et al. | |
| 9,863,203 B2 | | 1/2018 | Borden et al. | |
| 2004/0245775 A1 | * | 12/2004 | Muroi | F16L 27/107 285/223 |
| 2009/0255734 A1 | | 10/2009 | Williams | |
| 2015/0308216 A1 | | 10/2015 | Wiggins et al. | |
| 2016/0186864 A1 | | 6/2016 | vom Stein | |

FOREIGN PATENT DOCUMENTS

CN 106090027 8/2016

OTHER PUBLICATIONS

International Search Report and Written Opinion; PCT/US2020/058222; dated Jan. 22, 2021; US.
"Adiprene LF 750D"; Chemtura; Sep. 29, 2011; US.
"Rubber Hardness Chart"; Technical Resources (https:/mykin.com/rubber-technical-resources); 2011; US.
"Proxima Material Handling Guide"; Materia, Inc.; 2016; US.

* cited by examiner

*Primary Examiner* — David Carroll
(74) *Attorney, Agent, or Firm* — Dennis D. Brown; Brown Patent Law, P.L.L.C.

(57) ABSTRACT

A low cost, disposable, molded reinforcing insert which has a metal ring or a circular arrangement of threaded metal inserts encased therein, a low cost disposable stripper rubber for drill pipes or other tubulars which includes the molded reinforcing insert, and molding methods for forming the reinforcing insert and the stripper rubber.

13 Claims, 6 Drawing Sheets

STRIPPER ELEMENT FOR WELLS AND REINFORCING INSERT THEREFOR

FIELD OF THE INVENTION

The present invention relates to sealing elements, commonly referred to as stripper rubbers, which are used in wells to seal around drill pipes and other tubulars and to strip away mud, debris, and fluid as the drill pipe or other tubular is pulled out of the well. The present invention also relates to reinforcing inserts for these sealing elements and to methods of forming the reinforcing inserts and sealing elements.

BACKGROUND OF THE INVENTION

For drilling and other operations in oil and/or gas wells, water wells, and other types of wells, one or more sealing elements, commonly referred to as stripper rubbers, are typically installed at the wellhead to seal around drill pipes, kellies, bottom hole assemblies and/or other tubulars and to strip away mud, debris and fluid from the exterior of the tubular as it is pulled out of the well.

By way of example, but not by way of limitation, stripper rubbers are often configured to include: a generally cylindrical upper section; a reinforcing metal insert which is molded into at least the upper section; a frusto-conical lower section which converges inwardly as it extends downwardly from the upper section; and a passageway which extends longitudinally through the stripper rubber element for receiving the drill pipe or other tubular.

Except for the reinforcing insert, the upper and lower sections of the stripper rubber are typically formed of natural or synthetic rubber material, a urethane material, or other stretchy elastic material which is sufficiently durable and wear resistant for use in such applications. As used herein and in the claims, unless otherwise expressly limited, the term "stripper rubber" refers to and includes stripper elements formed of any such materials.

The inside diameter of the longitudinal passageway of the stripper rubber will typically be less than the outside diameter of the drill pipe or other tubular so that the stretchy material of the stripper rubber conforms to and provides a tight seal around the exterior of the tubular as the tubular moves longitudinally through and/or rotates within the stripper rubber. In addition, the pressure in the well also acts against the tapered exterior of the lower frusto-conical section of the stripper rubber to push the stripper radially inward and thereby further tighten the seal around the tubular.

The reinforcing metal insert used in the upper section of the stripper rubber provides a supporting structure for bolts, or other attachments, used for installing the stripper rubber and also reinforces the stripper rubber against deformation. One well known type of reinforcing metal insert comprises a longitudinally extending, generally cylindrical body portion having a bolting flange formed on the upper longitudinal end thereof.

When forming the stripper rubber, the reinforcing metal insert is placed in the stripper mold so that the rubber, urethane or other stretchy material used for forming the stripper rubber encases all, or at least a portion, of the metal insert.

Due to their size, bulkiness, materials of construction, and manufacturing costs, the metal inserts used in stripper rubbers are too expensive to simply be disposed of after use and must be recovered, refurbished, and reused. Unfortunately, however, the recovery and refurbishing process for the metal inserts is also very costly, labor intensive, and time consuming. When a spent stripper rubber is removed from a well after use, the user must pay to have the spent element shipped back to the manufacturer. The manufacturer must then remove the rubber, urethane or other molded material which encases and is bonded to the metal insert. Next, the surface of the metal insert must be grit blasted in accordance with NACE SSPC SP 10 requirements to a near white metal finish. The surface of the metal insert must then also be primed prior to being placed in a stripper element mold to be re-encased in, and bonded with, the new rubber or urethane material. Finally, the refurbished and restored element must be shipped back to the user.

Consequently, for the reasons stated above, there has been a long-felt and unsatisfied need in the industry for an improved reinforcing insert for stripper rubber elements which (a) is much less costly to produce, (b) can be economically disposed of after use rather than having to be recovered, refurbished and reused, (c) is compatible and readily bonds with the urethane or other stretchy material used for encasing the insert and forming the stripper rubber, and (d) is substantially equivalent or superior to the prior metal inserts in terms of the reinforcing strength and resistance to deformation which it provides.

SUMMARY OF THE INVENTION

The present invention satisfies the needs and alleviates the problems discussed above. The present invention provides a molded reinforcing insert for stripper rubbers which (a) costs much less to produce than the prior metal inserts and (b) is substantially equivalent or superior to the prior metal inserts in terms of performance, strength, and resistance to deformation. Moreover, the stripper rubber produced using the inventive, low cost molded insert can be economically disposed of after use and simply replaced.

In one aspect, there is provided a reinforcing insert for reinforcing a stripper rubber for a drill pipe or other well tubular. The reinforcing insert preferably comprises: (i) a longitudinal axis which extends through the insert; (ii) a metal ring, or a circular arrangement of individual threaded inserts, which surrounds the longitudinal axis; (iii) a molded insert material in which the metal ring or the circular arrangement of individual threaded inserts is encased, the molded insert material having a Shore D hardness value of at least 55; and (iv) a plurality of bolting holes which extend through the metal ring, or through the individual threaded inserts, and through the molded insert material in which the metal ring or the circular arrangement of individual threaded inserts is encased.

In another aspect, there is provided a reinforcing insert, for reinforcing a stripper rubber, which preferably comprises: (i) a longitudinal axis which extends through the reinforcing insert; (ii) a longitudinally extending body portion of the reinforcing insert which is formed of a molded insert material having a Shore D hardness value of at least 55; (iii) a plurality of voids which extend radially through the longitudinally extending body portion of the reinforcing insert for filling the voids with a stripper material when installing the reinforcing insert in the stripper rubber; and (iv) a radially extending attachment ring portion of the reinforcing insert which surrounds the longitudinal axis and extends radially outward from an upper end of the longitudinally extending body portion. The radially extending attachment ring portion of the reinforcing insert comprises a metal ring, or a circular arrangement of individual threaded inserts, encased in the molded insert material In another aspect, there is provided a stripper rubber for a drill pipe or other well tubular. The stripper rubber preferably comprises: (i) a longitudinal axis which extends through the stripper rubber and (ii) a passageway which extends longitudinally through the stripper rubber for receiving the drill pipe or other well tubular. The stripper rubber is preferably formed of a molded stripper material having a Shore A hardness value of not more than 85. The stripper rubber preferably further comprises a reinforcing insert which is at least partially encased in the molded stripper material of the stripper rubber and which surrounds the longitudinal axis. The reinforcing insert preferably comprises: (a) a metal ring or a circular arrangement of individual threaded inserts and (b) a molded insert material, different from the molded stripper material, in which the metal ring or the circular arrangement of individual threaded inserts is encased. The molded insert material preferably has a Shore D hardness value of at least 55.

In another aspect, there is provided a method for forming a stripper rubber for a drill pipe or other well tubular. The method preferably comprises the step of (a) positioning a circular metal ring in an insert mold for forming a molded reinforcing insert, the metal ring comprising (i) an inner edge, (ii) an outer edge, (iii) a radial width which extends from the inner edge to the outer edge, (iv) an upper radial surface, (v) a lower radial surface. (vi) a longitudinal thickness which extends from the upper radial surface to the lower radial surface, and (vii) a plurality of bonding voids which extend longitudinally through the metal ring from the upper radial surface to the lower radial surface.

Next, the inventive method preferably comprises the steps of: (b) filling the insert mold and the bonding voids of the metal ring with an insert molding material having a Shore D hardness value of at least 55; (c) curing the insert molding material to form the molded reinforcing insert, the molded reinforcing insert comprising the metal ring encased in the insert molding material and a plurality of bolting holes which extend through the metal ring and through the insert molding material in which the metal ring is encased; (d) removing the molded reinforcing insert from the insert mold; (e) placing the molded reinforcing insert in a stripper mold for forming the stripper rubber; (f) filling the stripper mold with a stripper molding material, different from the insert molding material, having a Shore A hardness value of not more than 85; and (g) curing the stripper molding material to form the stripper rubber. At least a portion of the molded reinforcing insert is encased in the stripper molding material of the stripper rubber. In addition, the stripper rubber comprises a passageway which extends longitudinally through the stripper rubber for receiving the drill pipe or other well tubular.

Further aspects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
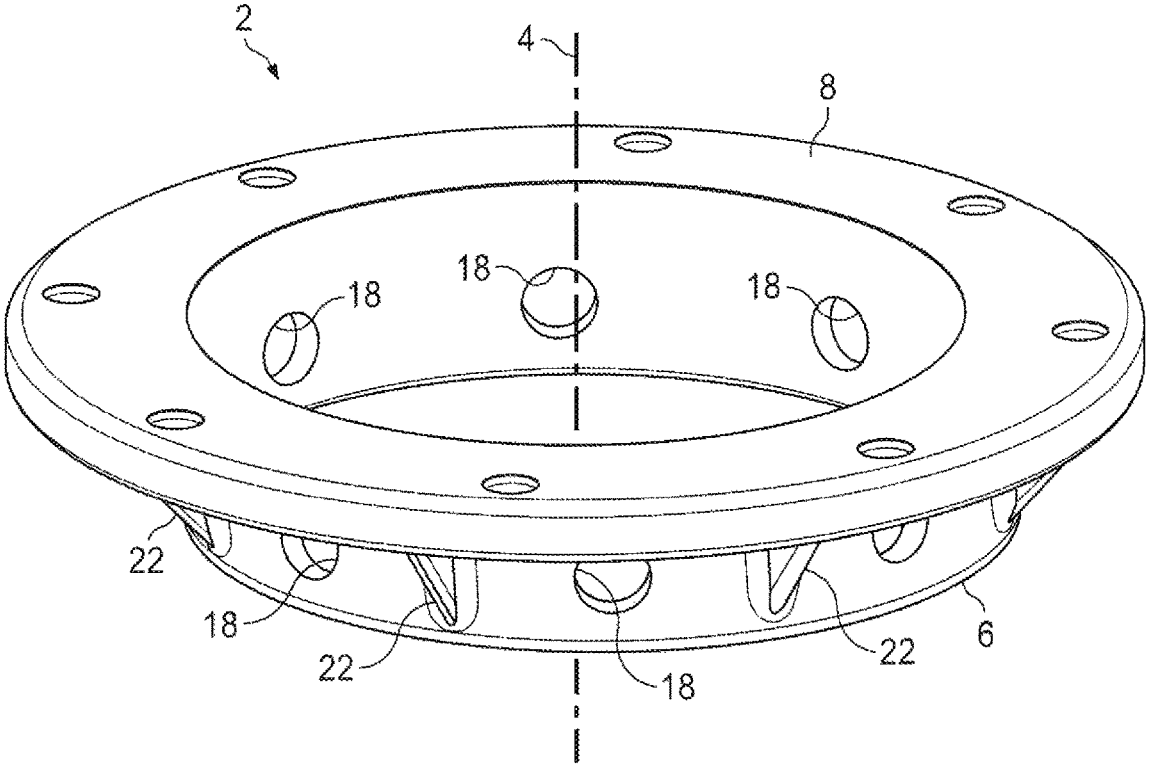
FIG. 1 is a top perspective view of an embodiment 2 of the molded reinforcing insert provided by the present invention.
Figure 2:
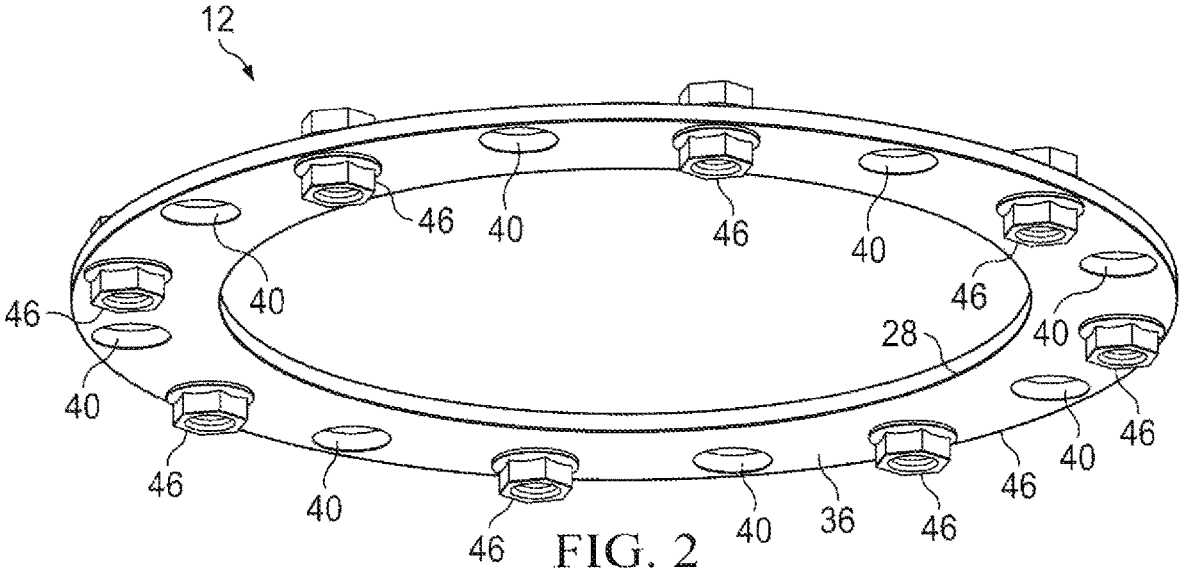
FIG. 2 is a perspective view of a metal bolting ring 12 used in the inventive reinforcing insert 2.
Figure 3:
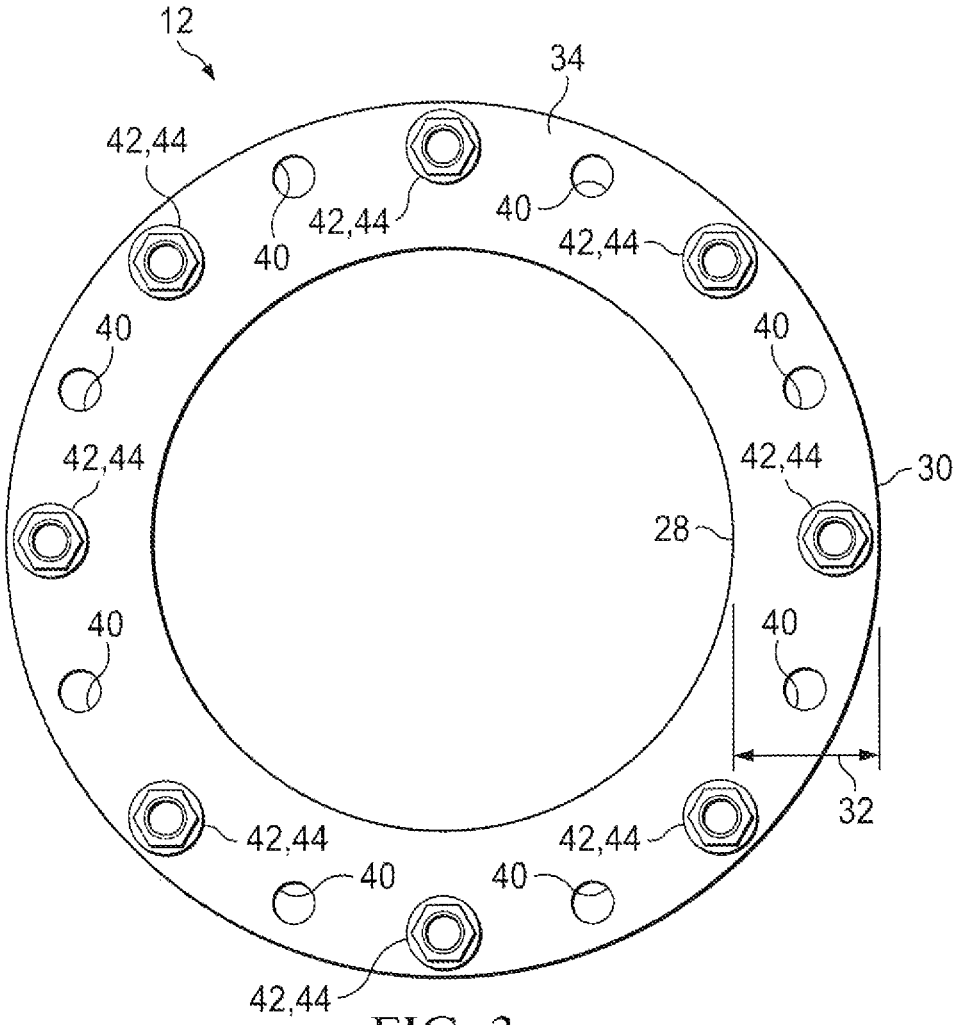
FIG. 3 is a plan view of the metal bolting ring 12.
Figure 4:
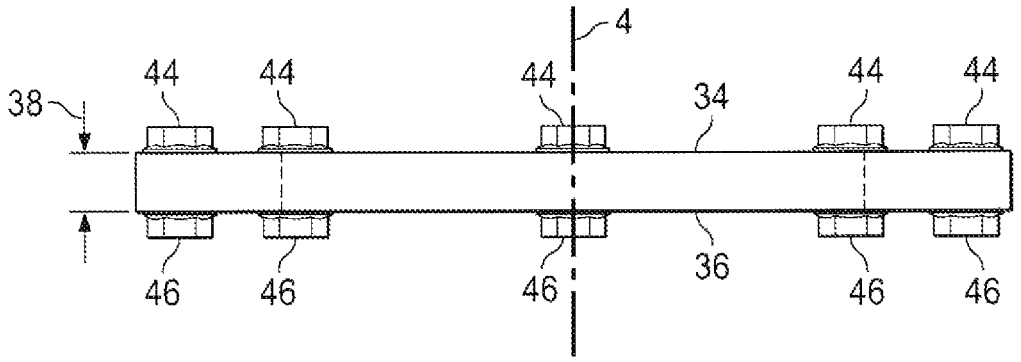
FIG. 4 is an elevational side view of the metal bolting ring 12
Figure 5:
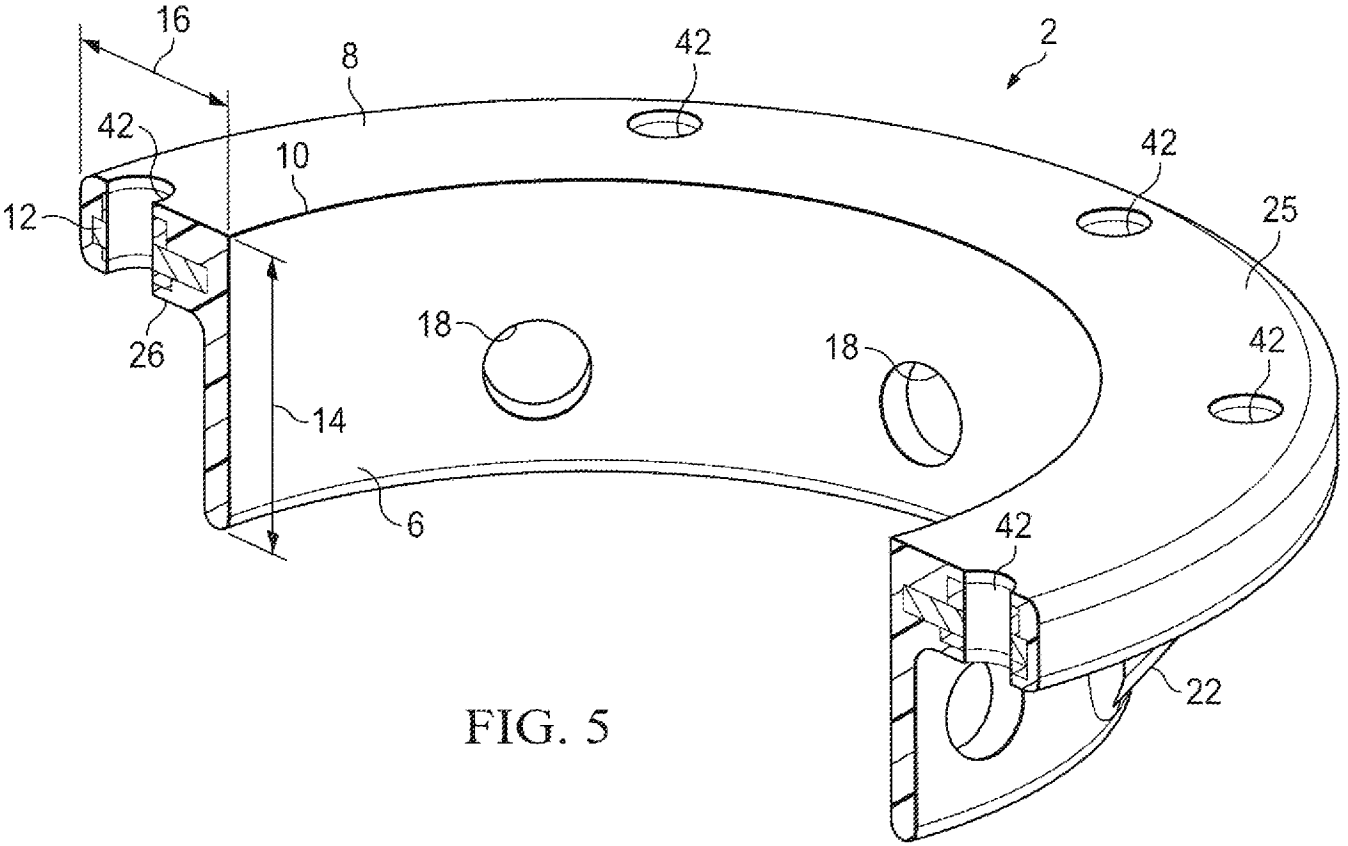
FIG. 5 is a cutaway view of the inventive molded reinforcing insert 2.
Figure 6:
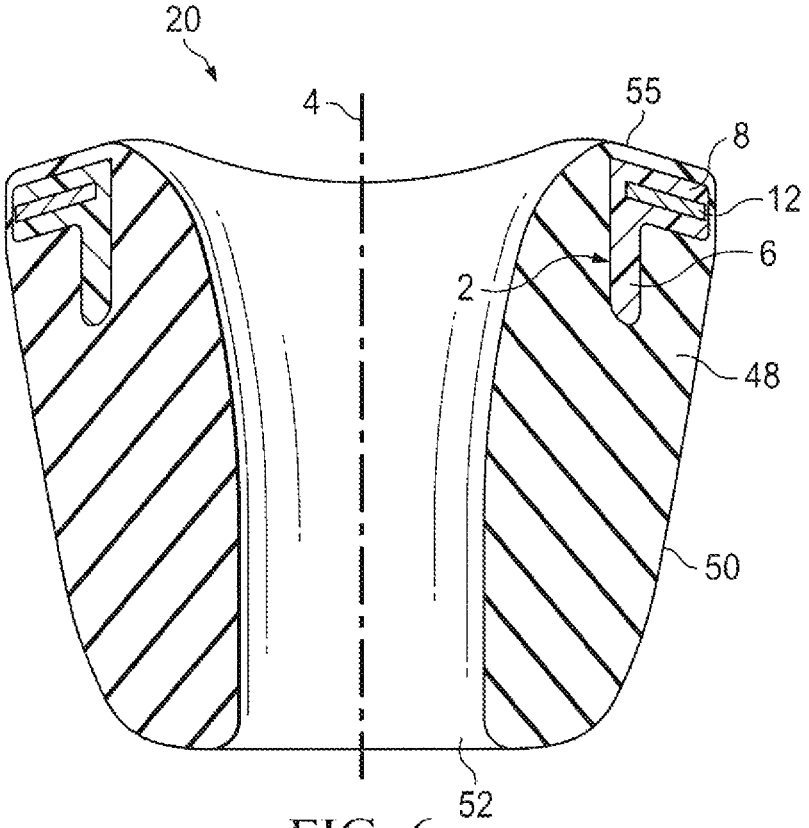
FIG. 6 is a cutaway elevational view of an embodiment 20 of the stripper rubber provided by the present invention.
Figure 7:
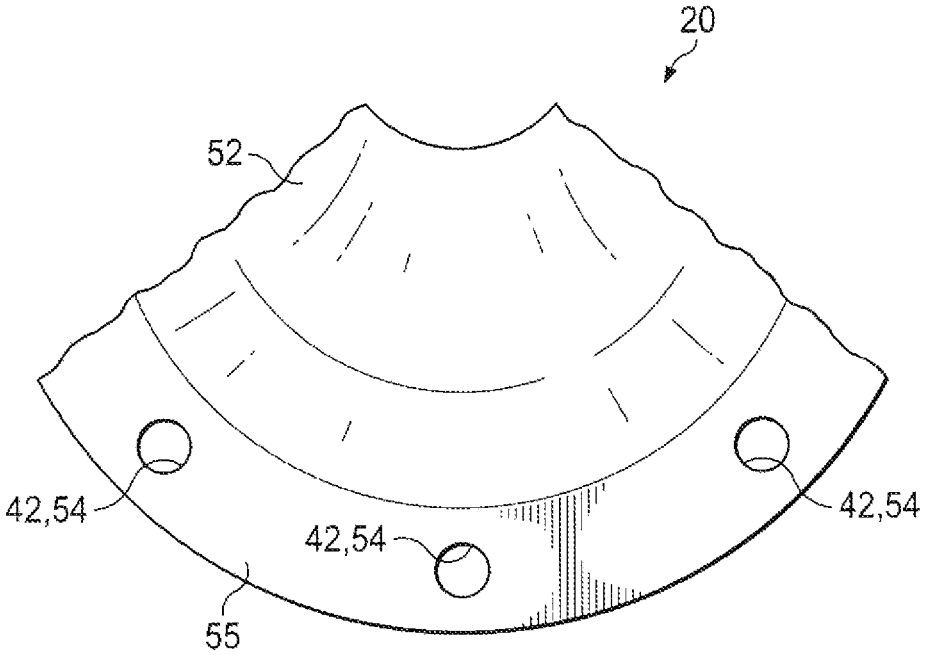
FIG. 7 is a top view of the inventive stripper rubber 20.

An embodiment 2 of the molded reinforcing insert provided by the present invention is illustrated in FIGS. 1-5. The molded insert 2 is molded as a single piece which preferably comprises: a longitudinal axis 4 which extends through the molded insert 2; a longitudinally extending body portion 6 of the molded insert 2 which preferably entirely surrounds or substantially surrounds the longitudinal axis 4; and a radially extending attachment ring portion 8 of the molded insert 2 which surrounds the longitudinal axis 4 and extends radially outward from an upper end 10 of the longitudinally extending body portion 6. The molded insert 2 further comprises a continuous metal ring 12 which is encased in the molded material of the radially extending attachment ring portion 8 of the insert 2 and which also surrounds the longitudinal axis 4.

The insert molding material used in forming the longitudinally extending body portion 6 and the radially extending attachment ring portion 8 of the molded insert 2, and which encases the metal ring 12, is preferably an elastomer or other polymer material having a high Shore D hardness value of at least 55, or at least 60, or in the range of from 60 to 90, or at least 65, or in the range of from 65 to 85.

Examples of elastomers and other polymer materials which can be formulated to provide high Shore D hardness values suitable for use in forming the molded insert 2 include, but are not limited to, polyurethanes (e.g., polyether polyurethanes, polyester polyurethanes, and polycarbonate-based polyurethanes), epoxies, polyolefins, and cross-linked polymers. The insert molding material used for forming the molded insert 2 and encapsulating the metal ring 12 is most preferably a polyurethane. Examples of commercially-available prepolymers preferred for use in forming the molded insert 2 include: (a) Adiprene® LF 750D, a TD-terminated polyether prepolymer available from Chemtura Corporation, which is preferably cured using 4,4'-Methylenebis(2-chloroaniline) or Dimethylthiotoluenediamine to a Shore D hardness of 73-75 or (b) PROXIMA® HPR 2100, a thermoset resin available from Materia, Inc. which provides a Shore D hardness of 82.

The elastomer or other polymer material used for forming the molded insert 2 can also include one or more fillers or other additives for increasing the hardness or density of the insert molding material, or for improving other properties. Examples of possible additives include but are not limited to ceramic fiber, fiberglass, carbon fiber. Kevlar® and similar materials.

The integrally molded combination of the longitudinal body portion 6 and the radial attachment ring portion 8 of the reinforcing insert 2 give the surrounding wall of the insert 2 an inverted L cross-sectional shape. The longitudinal length 14 of the longitudinally extending body portion 6 of the molded insert 2 is preferably in the range of from about 0.75 to about 5 times (more preferably from about 1 to about 3 times) the radial width 16 of the radially extending attachment ring portion 8. The longitudinally extending body portion 6 is preferably a generally cylindrical structure having a plurality, preferably a series, of substantially right angle, triangular strengthening brace structures 22 which are integrally formed during the molding process between the outer side wall 24 of the longitudinally extending body portion 6 and the lower surface 26 of the radially extending attachment ring portion 8 of the molded insert 2.

As will be discussed more fully below, a plurality of circular holes, apertures of other shapes, or other voids 18 (preferably a series of voids 18 located between the substantially triangular strengthening brace structures 22) are preferably formed radially through the longitudinally extending body portion 6 of the molded insert 2 for assisting in bonding the inventive molded insert 2 in the inventive stripper rubber 20.

The metal ring 12 which is encased in the molded insert material of the radially extending attachment ring portion 8 of the insert 2 is preferably a flat, circular metal ring which comprises: an inner circular edge 28 which surrounds the longitudinal axis 4; an outer circular edge 30 which surrounds the longitudinal axis 4; a radial width 32 which extends from the inner edge 28 to the outer edge 30; an upper radial surface 34 which extends from the inner edge 28 to the outer edge 30; a lower radial surface 36 which extends from the inner edge 28 to the outer edge 30; and a longitudinal thickness 38 which extends from the upper radial surface 34 to the lower radial surface 36.

The metal ring 12 also preferably comprises a plurality (preferably a series) of circular holes, apertures of other shapes, or other bonding voids 40 which extend longitudinally through the metal ring 12 from the upper radial surface 34 to the lower radial surface 36 and which are filled, during the process of molding the inventive reinforcing insert 2, with the high hardness insert molding material.

The longitudinal thickness 38 of the metal ring 12 is preferably in the range of from about ⅛ inch to 7⁄16 inch or from ⅛ inch to ⅜ inch. The thickness 38 of the metal ring 12 is more preferably in the range of from 3⁄16 inch to 516 inch and is most preferably about % inch. Examples of metals suitable for use in forming the metal ring 12 include, but are not limited to, mild steel and stainless steel.

The metal ring 12 is preferably a bolting ring which also comprises a plurality of bolting holes 42 which extend longitudinally through the metal ring 12. More preferably, the metal ring 12 has a series of the bolting holes 42 formed therethrough such that the bonding voids 40 of the metal ring 12 are located between the bolting holes 42. For each of the bolting holes 42, the metal ring 12 also preferably comprises at least one of (a) a nut or other internally threaded element 44 which is welded to the upper radial surface 34 of the metal ring 12 in alignment with the bolting hole 42 and/or (b) a nut or other internally threaded element 46 which is welded to the lower radial surface 36 of the metal ring 12 in alignment with the bolting hole 42. Each of the internally threaded elements 44 and 46 is preferably a serrated flange locknut which is welded to the metal ring 12.

During the molding process for forming the inventive molded insert 2, the high hardness insert molding material is prevented from blocking the bolting holes 42 of the metal ring 12 so that the bolting holes 42 also extend through the insert molding material which encases the metal ring 12 (i.e., through the upper surface 25 and the lower surface 26 of the radially extending attachment ring portion 8 of the molded insert 2).

Although the metal ring 12 and the radially extending attachment ring portion 8 of the molded insert 2 have been describe as having bolting holes 42 provided therethrough which will be used for bolting the inventive stripper rubber 20 in place in a drilling head system or elsewhere at the wellhead, it will be understood that cam pins or other attachment structures or elements can alternatively project from or be provided by the metal ring 12, and/or by the radially extending attachment ring portion 8 of the molded insert 2, for installing the stripper rubber 20 for service at the wellhead.

In a first stage of the method of the present invention, the inventive reinforcing insert 2 is preferably formed by: (a) grit blasting the surfaces of the metal ring 12 and applying a primer thereto; (b) positioning the treated metal ring 12 in a mold for forming the molded reinforcing insert 2; (c) filling the insert mold, and the bonding voids 40 of the metal ring 12, with the high hardness elastomer material or other high hardness polymer material (i.e., the insert molding material); (d) curing the insert molding material so that the inventive reinforcing insert 2 is formed as one continuous piece which includes the radially extending attachment ring portion 8 of the insert 2, with the metal ring 12 encased therein, and preferably also includes the longitudinally extending body portion 6; and (d) removing the molded reinforcing insert 2 from the insert mold.

Figure 8:
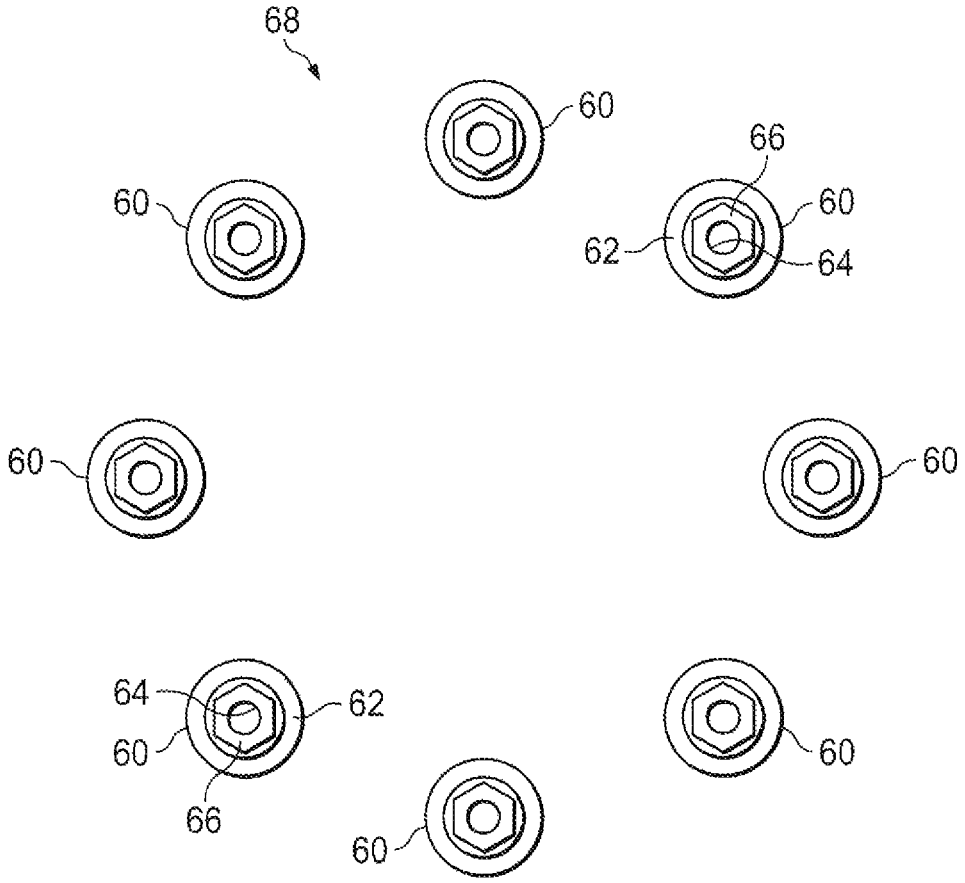
FIG. 8 is a circular arrangement 68 of individual threaded inserts 60 which replace the metal ring 12 in an alternative embodiment of the inventive reinforcing insert.

In an alternative embodiment, the metal ring 12 of the inventive reinforcing insert 2 can be replaced with a plurality of individual threaded inserts 60. Each of the individual threaded inserts 60 preferably comprises: a metal plate (e.g., a wide metal washer) 62 having a bolting hole 64 formed therethrough; a nut or other internally threaded element 66 which is welded to the upper surface of the plate 62 in alignment with the bolting hole 64; and/or a nut or other internally threaded element 66 which is welded to the lower surface of the metal plate 62 in alignment with the bolting hole 64. The internally threaded elements 66 used in forming the individual inserts 60 are preferably locknuts having serrated flanges. In forming the alternative embodiment of the inventive reinforcing insert, the individual threaded inserts 60 are preferably held on pins in the mold for the reinforcing insert in a circular bolting arrangement 68 as illustrated in FIG. 8.

In yet another alternative embodiment, the individual threaded inserts can be T-nuts.

After the inventive reinforcing insert 2 is formed, the reinforcing insert 2 is used in accordance with a second stage of the method of the present invention to produce the inventive stripper rubber 20 by: (a) grit blasting the surfaces of the reinforcing insert 2 and applying a primer thereto; (b) placing the reinforcing insert 2 in a stripper mold for forming the stripper rubber 20; (c) filling the stripper mold, and the voids 18 of the longitudinally extending body ring portion 6 of the molded insert 2, if present, with a stretchy, elastic, stripper molding material; (d) curing the stripper molding material; and (e) removing the inventive stripper rubber 20 from the stripper mold.

The inventive stripper rubber 20 formed by the inventive two stage process preferably comprises: (a) an upper longitudinal segment or portion 48 of the stripper rubber 20 in which the inventive reinforcing insert 2 in its entirety, or at least the longitudinally extending body portion 6 thereof if present, is encased; (b) a lower segment 50 of the stripper rubber 20 which preferably tapers inwardly (in a straight, curved or other manner) as it extends downwardly from the upper segment 48; and (c) a generally cylindrical or other passageway 52 which extends longitudinally through the upper and lower segments 48 and 50 of the stripper rubber 20 for receiving a drill pipe or other well tubular. The upper and lower longitudinal segments 48 and 50 surround the common longitudinal axis 4 of the stripper rubber 20 and the reinforcing insert 2. The upper longitudinal segment 48 of the inventive stripper rubber 20 will preferably be generally cylindrical in shape or will preferably taper slightly inward (in a straight, curved or other manner) as it extends downwardly to the lower segment 50. The lower segment 50 will preferably be generally frusto-conical in shape.

When the inventive reinforcing insert 2 is fully encased in the upper segment 48 of the inventive stripper rubber 20, the stretchy, elastic, stripper molding material used for molding the stripper rubber 20 will preferably be prevented during the molding process from blocking at least the upper ends 54 of the bolting holes 42 of the reinforcing insert 2 so that the bolting holes 42 also extend upwardly through the upper end 55 of the upper segment 48 of the inventive stripper rubber 20. The series of bolting holes 42 preferably encircles the upper longitudinal end of the central, longitudinal passageway 52 of the stripper rubber 20.

The selection of the particular stretchy, elastic material used for molding the inventive stripper rubber 20 can vary depending upon such factors as the drilling medium involved and the dynamic pressures found in the drilling location, as well as the temperature of the drilling mud. The stretchy, elastic, stripper material used for molding the inventive stripper rubber 20 will preferably be an elastomer or other material having a Shore A hardness value of not more than 90, or not more than 85, or not more than 80, or not more than 75. Examples of elastomer materials suitable for forming the inventive stripper rubber 20 include, but are not limited to, polyurethane, natural rubber, butyl rubber, and nitrile rubber.

Figure 9:
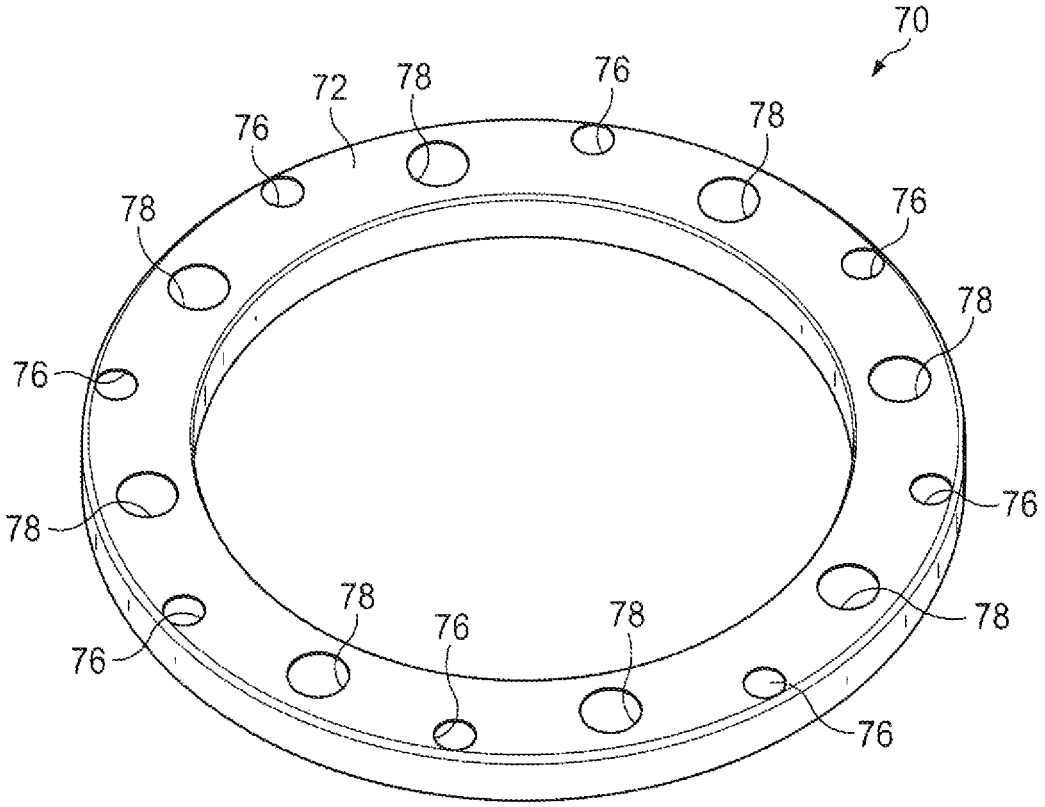
FIG. 9 is a perspective view of an alternative embodiment 70 of the molded reinforcing insert provided by the present invention.
Figure 10:
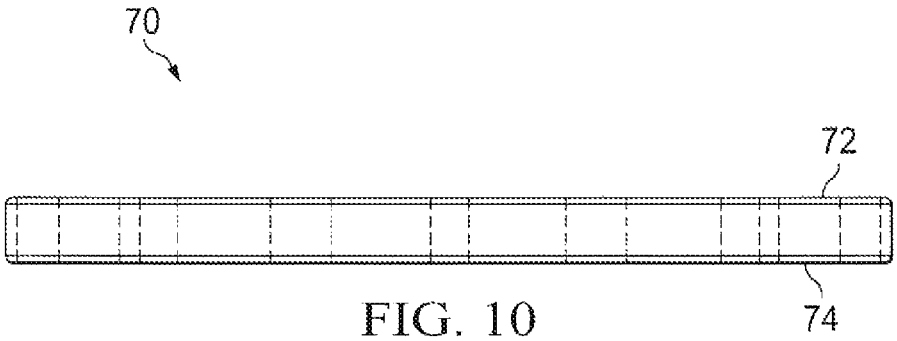
FIG. 10 is an elevational side view of the inventive molded reinforcing insert 70.

Although the molded reinforcing insert 2 has been described as having both (a) a radial ring portion 8 comprising the metal ring structure 12 encased in the insert molding material and (b) an integrally molded body portion 6 which extends longitudinally from the ring portion 8, the inventive reinforcing insert 2 can alternatively be formed without the longitudinally extending body portion 6. This is illustrated by the alternative embodiment 70 of the inventive reinforcing insert shown in FIGS. 9 and 10. The inventive reinforcing insert 70 is a molded flat ring structure wherein a metal bolting ring structure 12 as described above, or a circular arrangement of threaded inserts 60, is encased in any of the same insert molding materials as previously discussed for forming the reinforcing insert 2. The molded reinforcing insert 70 preferably comprises: an upper radial surface 72; a lower radial surface 74; a plurality of bolting holes 76 which extend longitudinally through the reinforcing insert 70 from the upper surface 72 to the lower surface 74, and which also extend through the bolting ring structure 12 or threaded inserts 60 encased within the insert 70; and a plurality of holes, apertures or other bonding voids 78 which extend through the insert 70 from the upper surface 72 to the lower surface 74. The boding voids 78, which will be filed with the stripper molding material during the stripper rubber molding process, are preferably positioned between the bolting holes 76.

Thus, the present invention is well adapted to carry out the objectives and attain the ends and advantages mentioned above as well as those inherent therein. While presently preferred embodiments have been described for purposes of this disclosure, the invention is not limited in its application to the details of the preferred embodiments. Numerous changes and modifications will be apparent to those in the art. Such changes and modifications are encompassed within this invention as defined by the claims. In addition, unless expressly stated, the phraseology and terminology employed herein are for purposes of description and not limitation.

What is claimed is:

1. A stripper rubber for a drill pipe or other well tubular comprising:

a longitudinal axis which extends through the stripper rubber;

a passageway which extends longitudinally through the stripper rubber for receiving the drill pipe or other well tubular;

the stripper rubber being formed of a molded stripper material; and the stripper rubber further comprising a reinforcing insert which is at least partially encased in the molded stripper material of the stripper rubber and which surrounds the longitudinal axis, the reinforcing insert comprising:

a metal ring or a circular arrangement of individual threaded inserts and a molded insert material, different from the molded stripper material, in which the metal ring or the circular arrangement of individual threaded inserts is encased, the molded insert material having a Shore D hardness value of at least 55.

2. The stripper rubber of claim 1 wherein:

the metal ring, or the circular arrangement of individual threaded inserts, is encased in a radially extending attachment ring portion of the reinforcing insert;

the reinforcing insert further comprises a body portion of the reinforcing insert which extends longitudinally from the radially extending attachment ring portion of the reinforcing insert; and the body portion of the reinforcing insert is formed of the molded insert material.

3. The stripper rubber of claim 2 wherein the reinforcing insert comprises the metal ring and the metal ring comprises:

an inner edge which surrounds the longitudinal axis, an outer edge which surrounds the longitudinal axis, a radial width which extends from the inner edge to the outer edge, an upper radial surface, a lower radial surface, a longitudinal thickness which extends from the upper radial surface to the lower radial surface, and a plurality of bonding voids which extend longitudinally through the metal ring from the upper radial surface to the lower radial surface and which are filled with the molded insert material.

4. The stripper rubber of claim 3 further comprising bolting holes which extend longitudinally through the radially extending attachment ring portion of the reinforcing insert, each of the bolting holes having an internally threaded element attached to at least one of the upper radial surface and/or the lower radial surface of the metal ring in alignment with the bolting hole.

5. The stripper rubber of claim 3 wherein:

the longitudinal thickness of the metal ring is in a range of from 3/16 inch to 5/16 inch and the body portion of the reinforcing insert has a longitudinal length, the radially extending attachment ring portion of the reinforcing insert has a radial width, and the longitudinal length of the body portion of the reinforcing insert is from 0.75 to 5 times the radial width of the radially extending attachment ring portion of the reinforcing insert.

6. The stripper rubber of claim 2 wherein the molded stripper material has a Shore A hardness value of not more than 90.

7. The stripper rubber of claim 2 wherein the reinforcing insert is entirely encased in the molded stripper material of the stripper rubber.

8. The stripper rubber of claim 2 wherein the reinforcing insert further comprises a plurality of voids which extend radially through the body portion of the reinforcing insert and are filled with the molded stripper material of the stripper rubber.

9. The stripper rubber of claim 1 comprising the reinforcing insert comprising the metal ring.

10. The stripper rubber of claim 9 wherein the molded stripper material has a Shore A hardness value of not more than 90.

11. The stripper rubber of claim 9 wherein the reinforcing insert is entirely encased in the molded stripper material of the stripper rubber.

12. The stripper rubber of claim 9 further comprising a plurality of voids which extend radially through a body portion of the reinforcing insert and are filled with the molded stripper material of the stripper rubber.

13. The stripper rubber of claim 9 comprising the metal ring having no bolting holes formed therethrough.

* * * * *